US009844867B2

(12) United States Patent
Hsieh

(10) Patent No.: US 9,844,867 B2
(45) Date of Patent: Dec. 19, 2017

(54) CUSHION DEVICE FOR CYLINDER OF PNEUMATIC TOOL

(71) Applicant: Chih Kuan Hsieh, Hemei Township, Changhua County (TW)

(72) Inventor: Chih Kuan Hsieh, Hemei Township, Changhua County (TW)

( * ) Notice: Subject to any disclaimer, the term of this patent is extended or adjusted under 35 U.S.C. 154(b) by 448 days.

(21) Appl. No.: 14/666,774

(22) Filed: Mar. 24, 2015

(65) Prior Publication Data

US 2016/0279779 A1 Sep. 29, 2016

(51) Int. Cl.
*B25D 17/24* (2006.01)
*B25D 9/08* (2006.01)

(52) U.S. Cl.
CPC ..... *B25D 17/24* (2013.01); *B25D 9/08* (2013.01); *B25D 17/245* (2013.01); *B25D 2250/275* (2013.01)

(58) Field of Classification Search
CPC ..... B25D 9/04; B25D 9/08; B25D 17/245
USPC ..... 173/17, 117, 137, 139, 162.1
See application file for complete search history.

(56) References Cited

U.S. PATENT DOCUMENTS 3,255,832 A * 6/1966 Leavell ..... B25D 9/08 173/133
4,388,972 A * 6/1983 Gidlund ..... B25D 9/16 173/162.1
4,476,408 A * 10/1984 Honsinger ..... H02K 1/2766 310/156.84
5,322,131 A * 6/1994 Pressley ..... B25D 17/043 173/162.1
5,533,579 A * 7/1996 Chu ..... B25D 17/245 173/13
5,813,477 A * 9/1998 Clay ..... B25D 17/043 173/1
6,161,628 A * 12/2000 Liu ..... B25D 9/20 173/114
6,192,997 B1 * 2/2001 Tsai ..... B25D 9/18 173/162.1
6,827,156 B1 * 12/2004 Hsiao ..... B25D 17/245 173/168
8,196,675 B2 * 6/2012 Chang ..... B25D 9/08 173/162.1
8,240,394 B2 * 8/2012 Kobayashi ..... B25D 9/18 173/162.1
2007/0158087 A1 * 7/2007 Chen ..... B25D 9/04 173/162.1

* cited by examiner

*Primary Examiner* — Nathaniel Chukwurah
(74) *Attorney, Agent, or Firm* — Alan D. Kamrath; Kamrath IP Lawfirm, P.A.

(57) ABSTRACT

A cushion device is used for a cylinder of a pneumatic tool, and the pneumatic tool contains: a body, a cylinder, a valve unit, a piston member, and a cushion washer. The body includes a grip and a fitting sleeve having a chamber, a closing face, and an opening. The cylinder is slidably fitted in the chamber, partially extends out of the fitting sleeve from the opening, and includes a room and an abutting portion. The valve unit is mounted between the room and the abutting portion. The piston member is accommodated in the room and slides along a movement axis. The cushion washer is made of a flexible rubber, is mounted in the chamber, and abuts against the closing face and the pressing face. The cushion washer includes at least one open segment which has at least one air groove each having a mouth parallel to the movement axis.

8 Claims, 9 Drawing Sheets

CUSHION DEVICE FOR CYLINDER OF PNEUMATIC TOOL

BACKGROUND OF THE INVENTION

The present invention relates to a cushion device, and more particularly to a cushion device for a cylinder of a pneumatic tool which reduces vibration.

DESCRIPTION OF THE PRIOR ART

A conventional pneumatic tool is driven by a high pressure air used as a power source. With reference to FIG. 9, the conventional pneumatic tool contains: a grip 10, a valve unit 20, a cylinder 30, and a piston member 40. The grip 10 includes an air inlet segment 101 connected with a high pressure air, an air passage 102 communicating with the air inlet segment 101, a control switch (not shown) for controlling the high pressure air to flow into the air inlet segment 101, and a cylindrical portion 103. The cylindrical portion 103 has a chamber 104 defined therein and communicating with the air passage 102. The valve unit 20 is mounted in the chamber 104 of the cylindrical portion 103, and one end of the cylinder 30 is inserted into the chamber 104 of the cylindrical portion 103, such that the cylinder 30 contacts with the valve unit 20. The cylinder 30 includes a room 301 defined therein and a flowing channel 302 formed between a front end of the room 301 and the valve unit 20, wherein the flowing channel 302 is in communication with the front end of the room 301 and the valve unit 20, and the piston member 40 is accommodated and slides in the room 301 of the cylinder 30. As turning on the control switch on the grip 10, the high pressure air flows into the valve unit 20 in the chamber 104 of the cylindrical portion 103 from the air inlet segment 101 of the grip 10 via the air passage 102, and the valve unit 20 controls the high pressure air to flow into the room 301 of the cylinder 30 and to push the piston member 40 toward a predetermined position, such that a tool head (not shown) is hit by the piston member 40, and the tool head stops the piston member 40, thereafter the valve unit 20 controls the high pressure air to flow into a front end of the room 301 of the cylinder 30 through the flowing channel 302, such that the piston member 40 is pushed by the high pressure air to slide backward to impact the valve unit 20, hence the piston member 40 is stopped by the valve unit 20, thus moving the piston member 40 to operate the pneumatic tool.

However, when the piston member 40 slides backward to impact the valve unit 20, a reaction force produces and passes toward user's hand, thus gripping the pneumatic tool difficultly and hurting the user's waist easily.

To overcome above-mentioned problem, a cylindrical cushion washer or a spring is fixed in the chamber of the cylindrical portion, such that the cylindrical cushion washer or the spring cushions impact force and absorbs vibration, when the piston member 40 slides backward to impact the valve unit 20, thereby absorbing vibration and decreasing reaction force which passes toward the user's hand. Nevertheless, the cylindrical cushion washer and the spring cannot cushion the impact force evenly to reduce the reaction force. In addition, the cylindrical cushion washer and the spring cause elastic fatigue in repeated use, thus increasing use cost.

The present invention has arisen to mitigate and/or obviate the afore-described disadvantages.

SUMMARY OF THE INVENTION

The primary objective of the present invention is to provide a cushion device for a cylinder of a pneumatic tool in which a cushion washer is mounted in a chamber of a fitting sleeve of a body, and the cushion washer abuts against a closing face of the chamber of the fitting sleeve and a pressing face of an abutting portion of a cylinder, wherein the cushion washer includes at least one open segment arranged on at least one end thereof, the open segment has at least one air groove and contacts with the closing face, such that when the piston member moves backward to impact the valve unit, the cushion washer and the at least one air groove produce a compression like an airbag to absorb the vibration doubly and to reduce a reaction force of the cylinder which passes toward a user's hand, thus protecting the user's wrist.

Another objective of the present invention is to provide a cushion device for a cylinder of a pneumatic tool in which the cushion washer includes the at least one open segment arranged on the at least one end thereof, and the open segment has the at least one air groove, hence the cushion washer does not cause elastic fatigue in repeated use, thus reducing use cost.

To obtain above-mentioned objectives a cushion device for a cylinder of a pneumatic tool provided by the present invention contains: a body, a cylinder, a valve unit, and a piston member.

A cushion device is used for a cylinder of a pneumatic tool, and the pneumatic tool contains: a body, a cylinder, a valve unit, a piston member, and a cushion washer.

The body includes a grip and a fitting sleeve fitted with the grip, the fitting sleeve has a chamber defined therein, a closing face formed on a first end thereof, and an opening formed on a second end thereof.

The cylinder is slidably fitted in the chamber of the fitting sleeve, and a part of the cylinder extends out of the fitting sleeve from the opening of the chamber, the cylinder includes a room formed therein and an abutting portion adjacent to the closing face of the chamber of the fitting sleeve.

The valve unit is mounted between the room and the abutting portion of the cylinder.

The piston member is accommodated in the room of the cylinder and slides forward and backward along a movement axis.

The cushion washer is made of a flexible rubber and is mounted in the chamber of the fitting sleeve, and the cushion washer abuts against the closing face of the chamber of the fitting sleeve and the pressing face of the abutting portion of the cylinder. The cushion washer includes at least one open segment arranged on at least one end thereof, the at least one open segment has the at least one air groove, and each of the at least one air groove having a mouth parallel to the movement axis of the piston member, the at least one open segment contacts with the closing face or/and the pressing, such that the at least one air groove forms a flexible press space, thus producing double flexibility by using the cushion washer which is made of the flexible rubber and the at least one air groove which forms the flexible press space.

DETAILED DESCRIPTION OF THE PREFERRED EMBODIMENTS

The present invention will be clearer from the following description when viewed together with the accompanying drawings, which show, for purpose of illustrations only, a preferred embodiment in accordance with the present invention.

Figure 1:
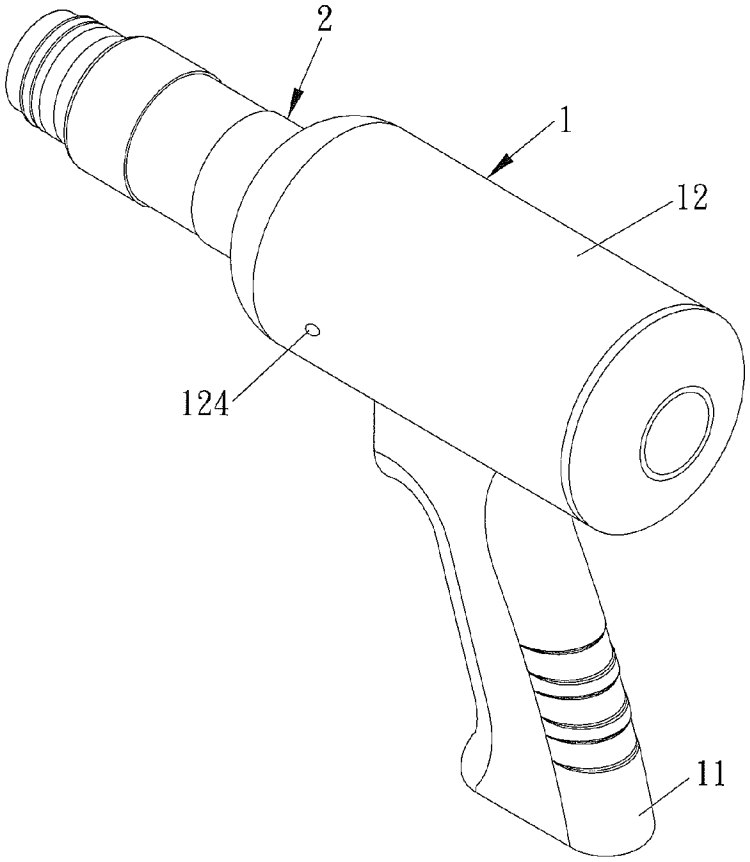
FIG. 1 is a perspective view showing the assembly of a pneumatic tool according to a preferred embodiment of the present invention.
Figure 2:
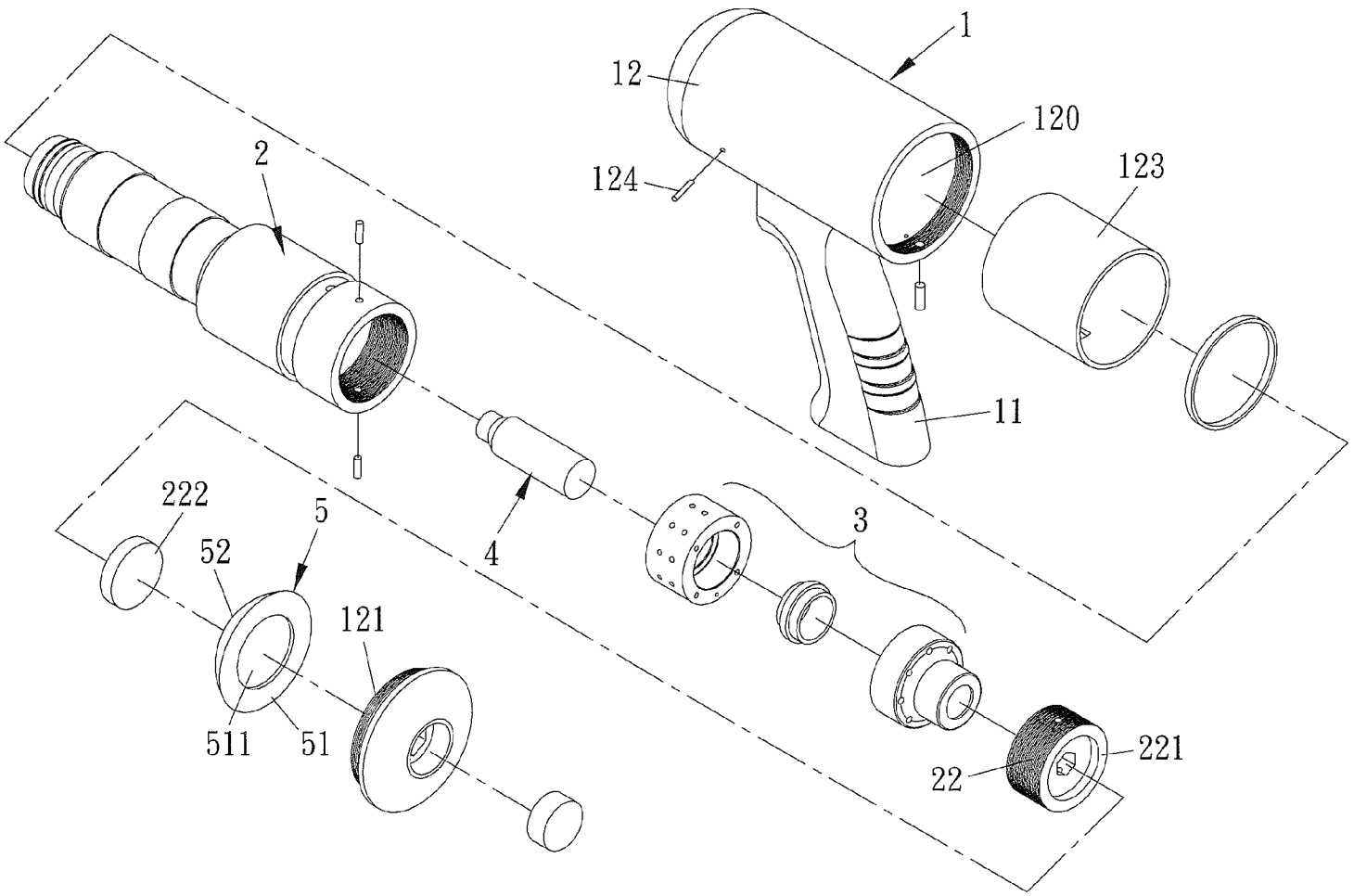
FIG. 2 is a perspective view showing the exploded components of the pneumatic tool according to the preferred embodiment of the present invention.
Figure 3:
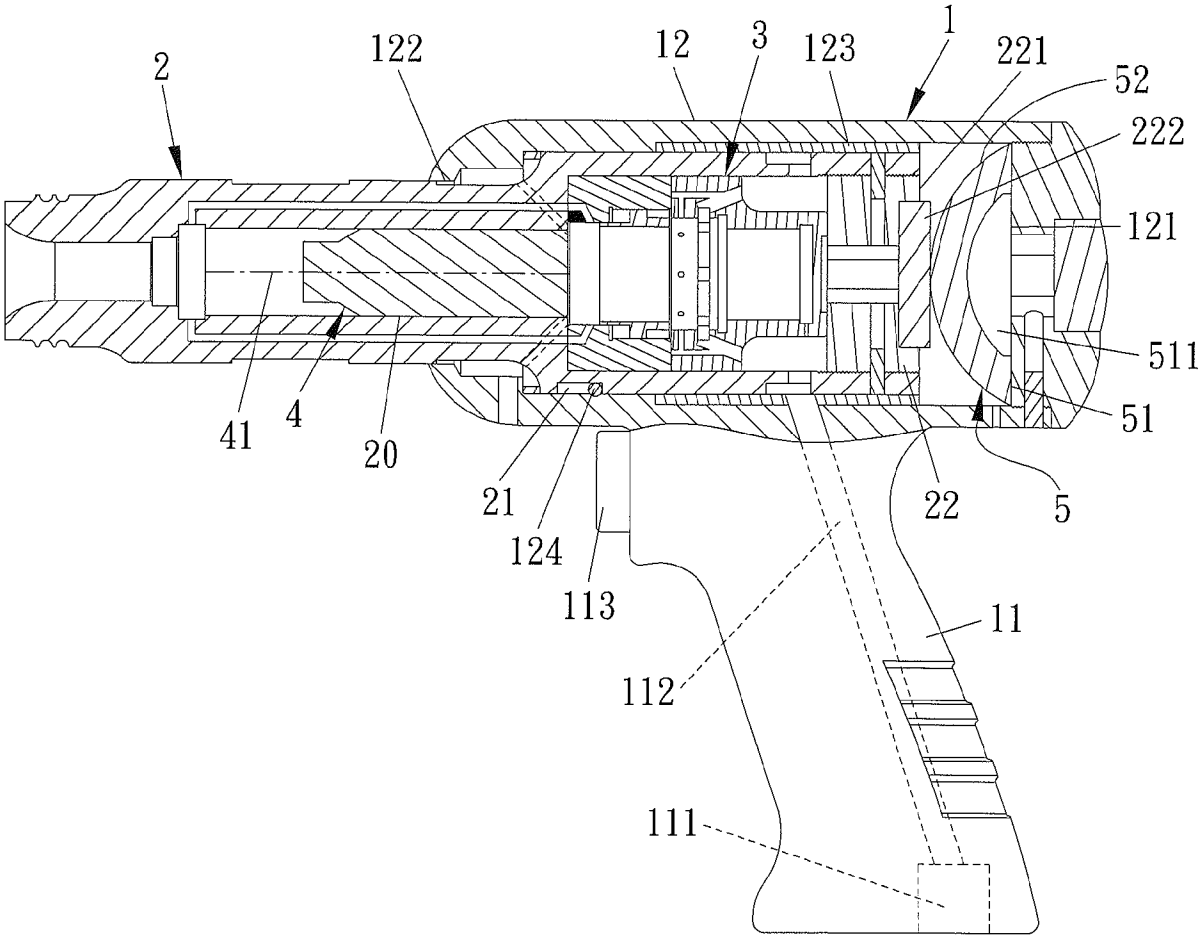
FIG. 3 is a cross sectional view showing the assembly of the pneumatic tool according to the preferred embodiment of the present invention.

With reference to FIGS. 1 to 3, a cushion device for a cylinder of a pneumatic tool according to a preferred embodiment of the present invention, wherein the pneumatic tool comprises: a body 1, a cylinder 2, a valve unit 3, a piston member 4, and a cushion washer 5, wherein the body 1 includes a grip 11 and a fitting sleeve 12 fitted with the grip 11, the grip 11 has an air inlet segment 111, an air passage 112 communicating with the air inlet segment 111, and a control switch 113 for controlling air to flow into the air inlet segment 111; the fitting sleeve 12 has a chamber 120 defined therein, a closing face 121 formed on a first end thereof, an opening 122 formed on a second end thereof, and a bushing 123 fitted on an inner wall of the chamber 120 of the fitting sleeve 12. The cylinder 2 is slidably fitted in the chamber 120 of the fitting sleeve 12, and a part of the cylinder 2 extends out of the fitting sleeve 12 from the opening 122 of the chamber 120. The cylinder 2 includes a room 20 formed therein, a limiting slot 21 defined on an outer side thereof to insert a defining element 124 of the fitting sleeve 12, and an abutting portion 22 adjacent to the closing face 121 of the chamber 120 of the fitting sleeve 12, wherein the abutting portion 22 has a pressing face 221 relative to the closing face 121 of the chamber 120 of the fitting sleeve 12, and the pressing face 221 has a protective pad 222 fixed on a central position thereof. The valve unit 3 is mounted between the room 20 and the abutting portion 22 of the cylinder 2, such that high pressure air flows toward the valve unit 3 via the air passage 112 of the grip 11. The piston member 4 is accommodated in the room 20 of the cylinder 2 and slides forward and backward along a movement axis 41. The cushion washer 5 is made of a flexible rubber and is mounted in the chamber 120 of the fitting sleeve 12, and the cushion washer 5 abuts against the closing face 121 of the chamber 120 of the fitting sleeve 12 and the pressing face 221 of the abutting portion 22 of the cylinder 2. The cushion washer 5 includes an open segment 51 arranged on a first end thereof and corresponding to the closing face 121, the open segment 51 has at least one air groove 511 with a mouth parallel to the movement axis 41 of the piston member 4, and the open segment 51 contacts with the closing face 121, such that the at least one air groove 511 forms a flexible press space. The cushion washer 5 also includes a raised close segment 52 formed on a second end thereof and corresponding to the pressing face 221, the close segment 52 contacts with the protective pad 222 of the pressing face 221 or the pressing face 221, hence the cushion washer 5 (made of the flexible rubber) and the at least one air groove 511 (forming the flexible press space) produce double flexibility.

Figure 4:
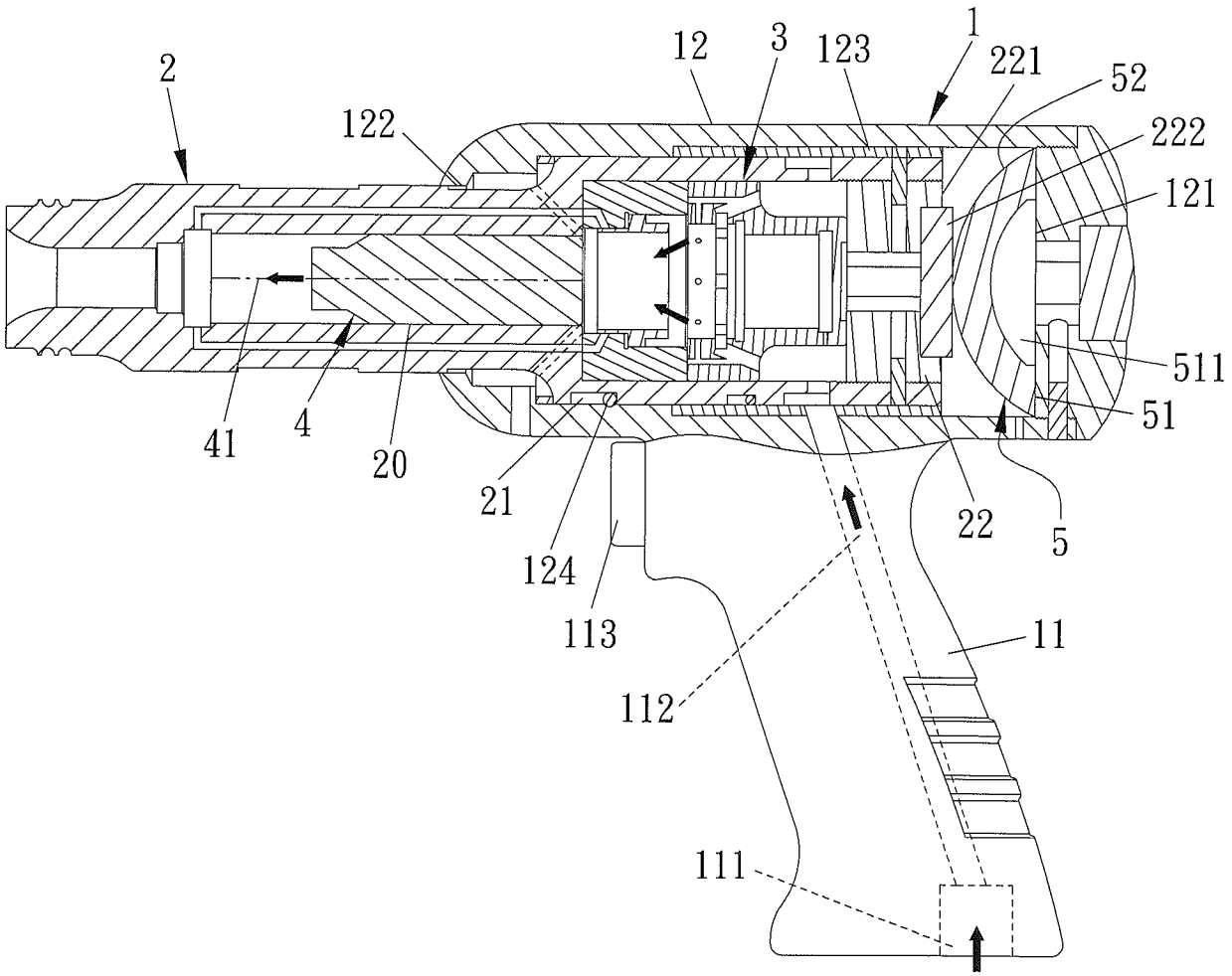
FIG. 4 is a cross sectional view showing the operation of a piston member of the pneumatic tool according to the preferred embodiment of the present invention.
Figure 5:
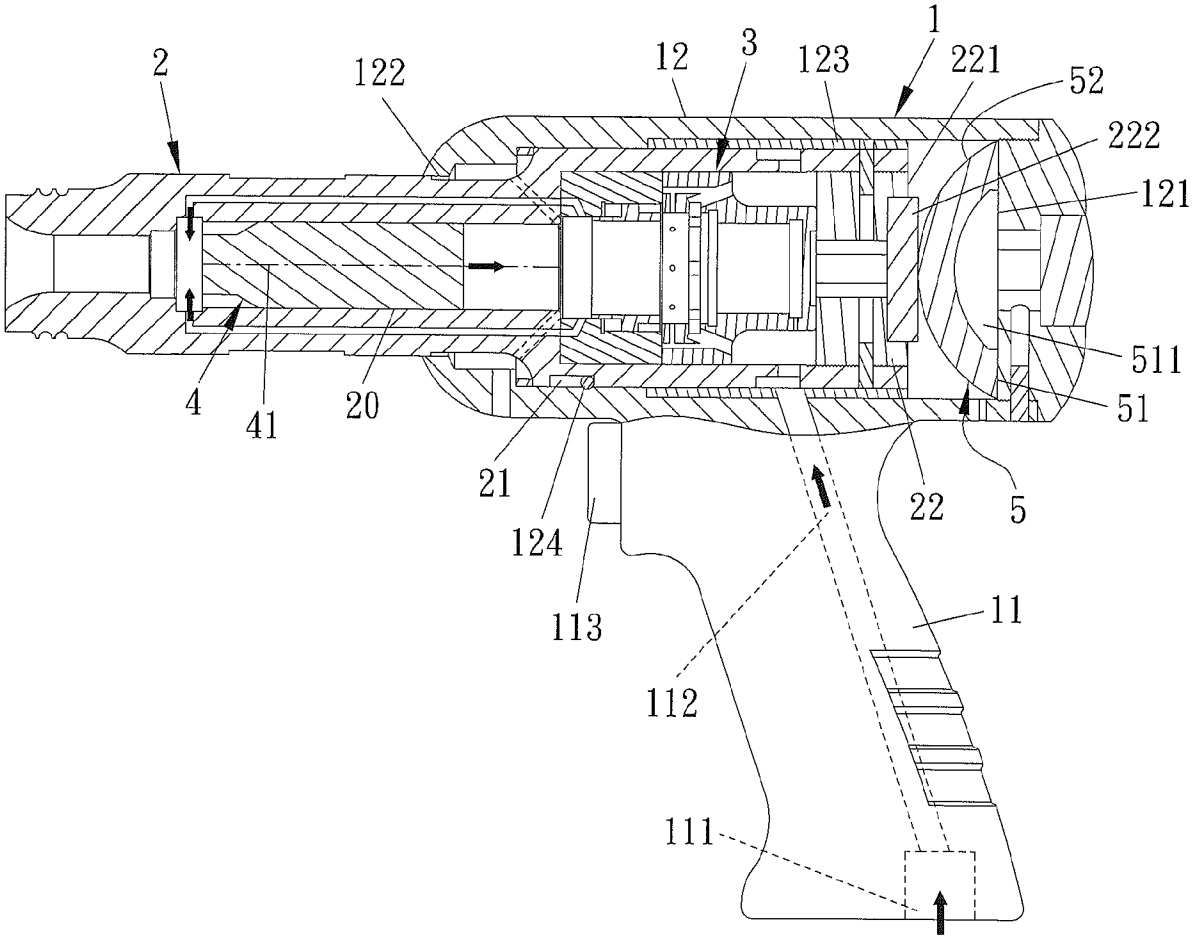
FIG. 5 is another cross sectional view showing the operation of the piston member of the pneumatic tool according to the preferred embodiment of the present invention.
Figure 6:
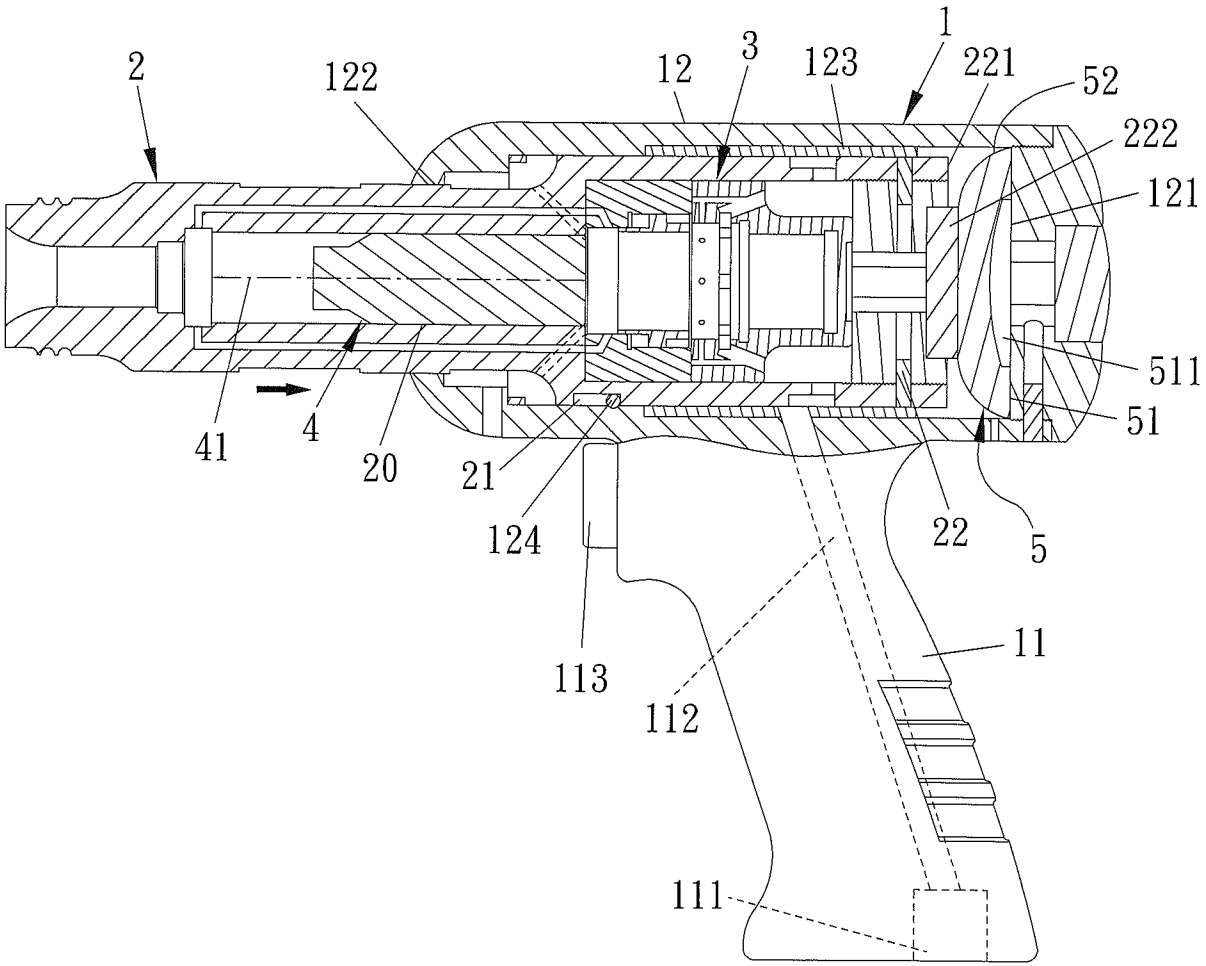
FIG. 6 is also another cross sectional view showing the operation of the piston member of the pneumatic tool according to the preferred embodiment of the present invention.

Referring to FIG. 4, after the control switch 113 on the grip 11 is turned on, the high pressure flows into a rear end of the room 20 of the cylinder 2 via the air passage 112 of the grip 11 and the valve unit 3 to push the piston member 4, and the piston member 4 moves toward a front end of the room 20 to impact a tool head (not shown) and is stopped by the tool head. As shown in FIGS. 5 and 6, the high pressure air is controlled by the valve unit 3 to flow into the front end of the room 20 of the cylinder 2 to push the piston member 4, hence the piston member 4 moves backward toward the rear end of the room 20 to impact the valve unit 3, and the valve unit 3 drives the cylinder 2 to move backward, such that the cushion washer 5 and the at least one air groove 511 produce compression like airbag to absorb vibration doubly and to reduce reaction force which passes toward user's hand, thus pushing the piston member 4 forward and backward.

Figure 7:
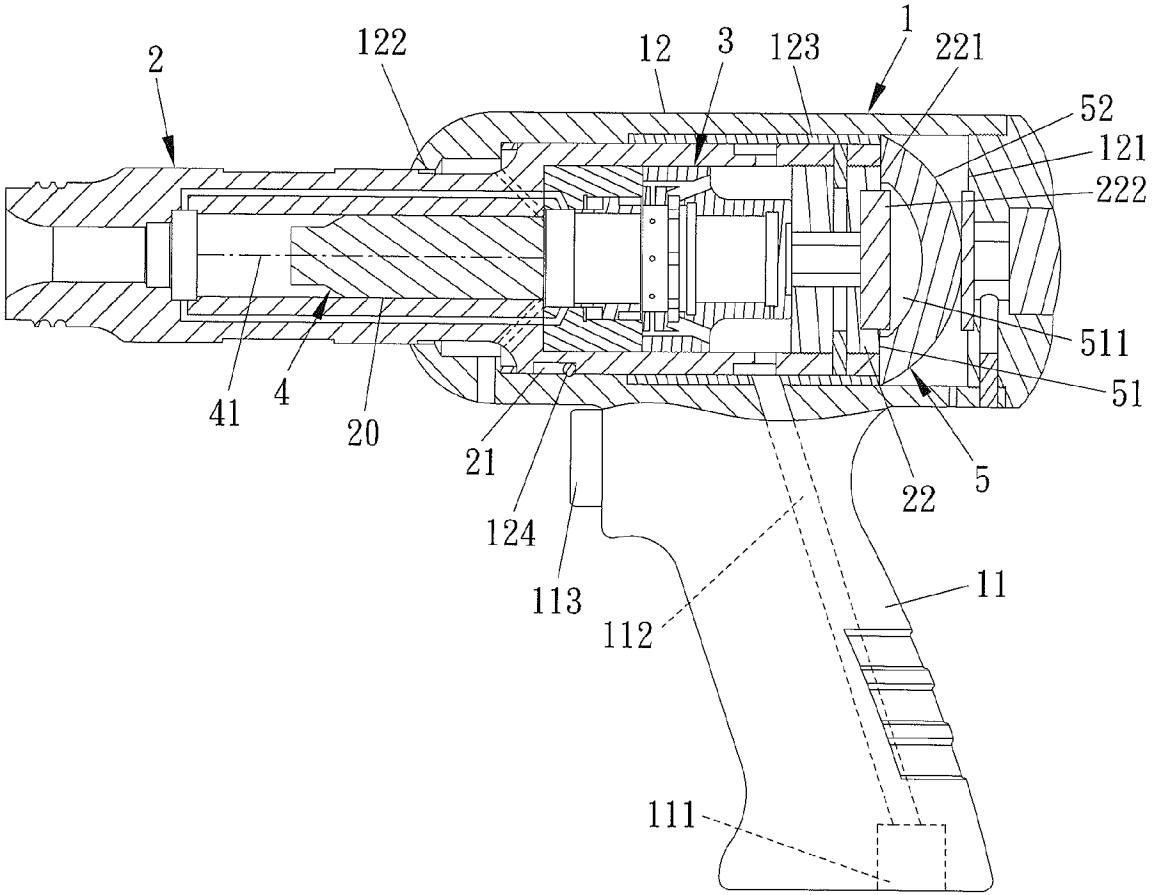
FIG. 7 is a cross sectional view showing the assembly of a pneumatic tool according to another preferred embodiment of the present invention.
Figure 8:
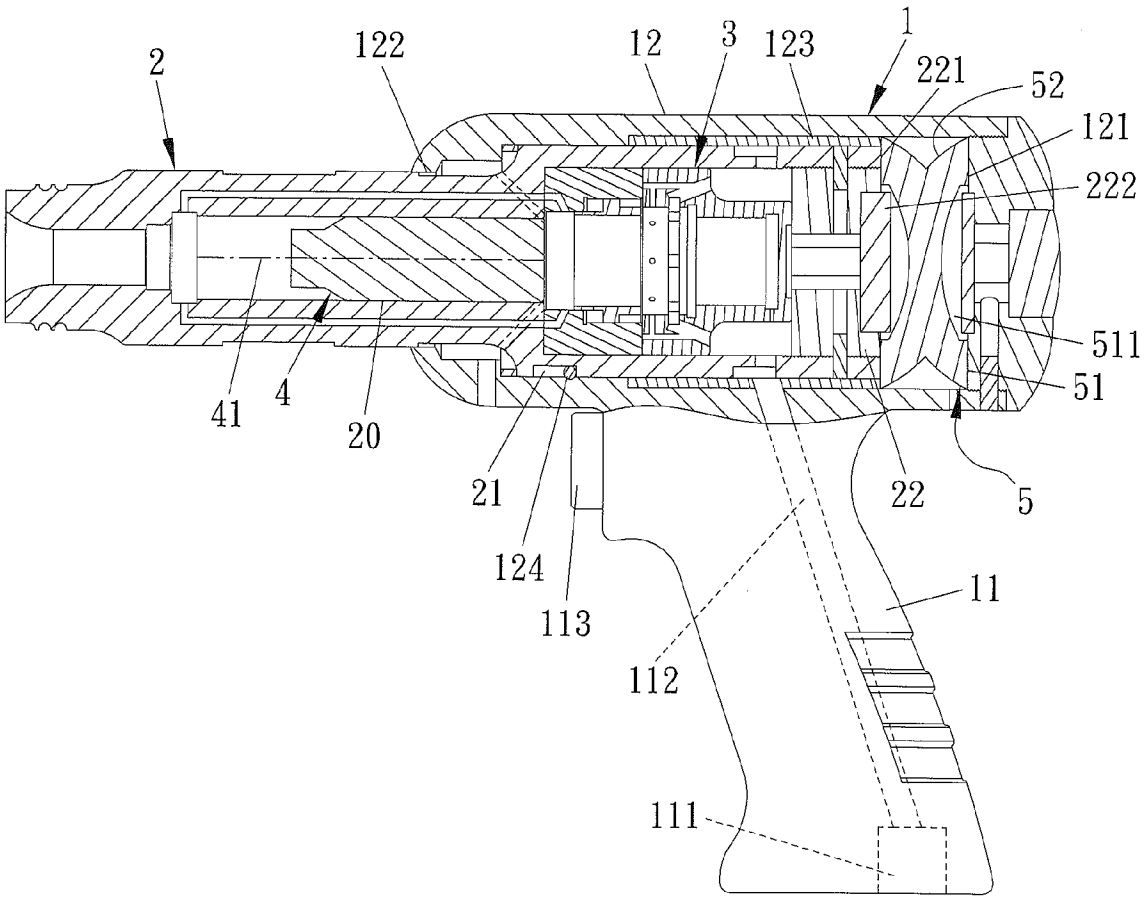
FIG. 8 is a cross sectional view showing the assembly of a pneumatic tool according to another preferred embodiment of the present invention.
Figure 9:
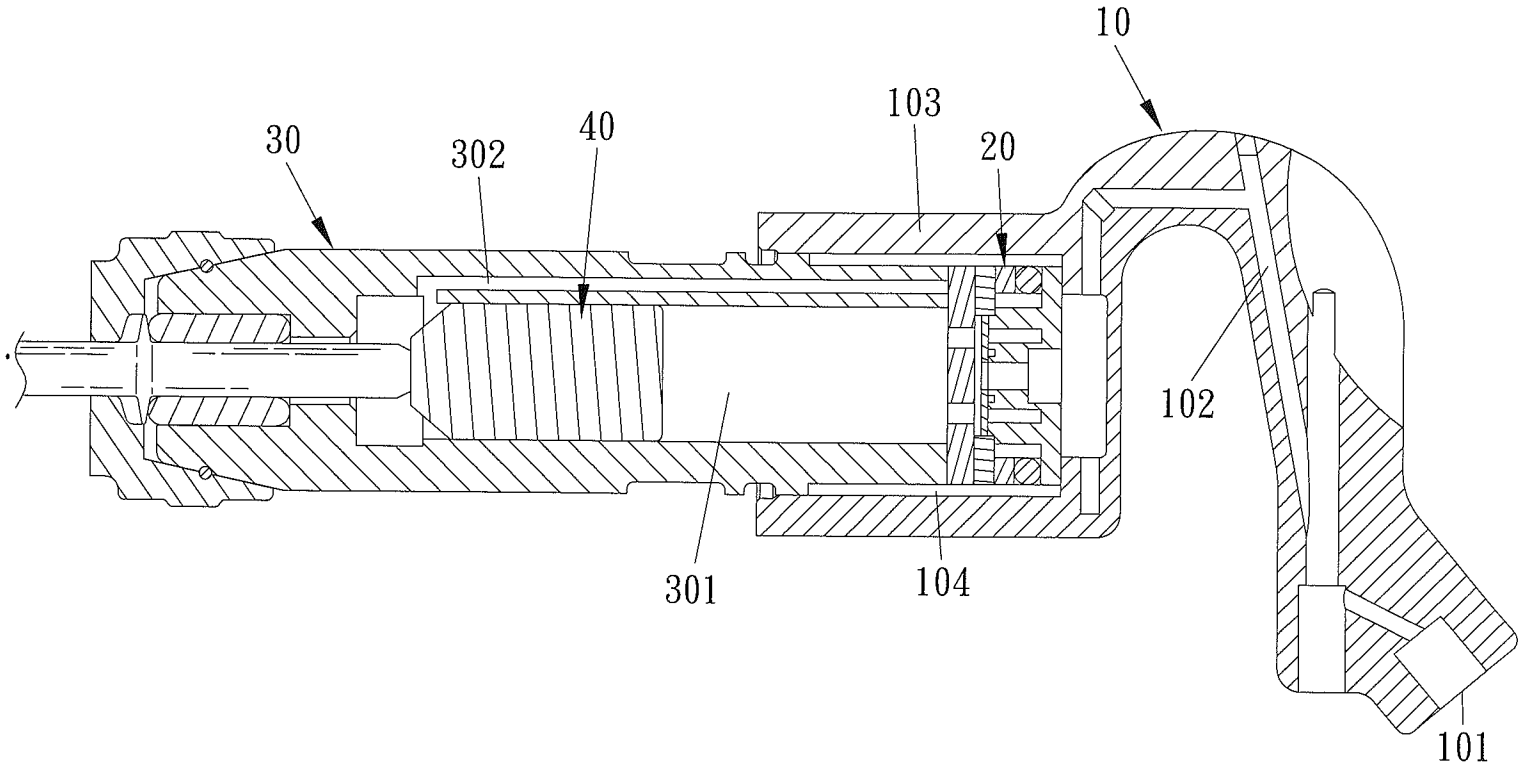
FIG. 9 Prior Art
FIG. 9 is a cross sectional view of a conventional pneumatic tool.

As illustrated in FIG. 7, in anther embodiment, the cushion washer 5 includes an open segment 51 arranged on a first end thereof and corresponding to an abutting portion 22 of a cylinder 2, and the open segment 51 has at least one air groove 511 with a mouth parallel to a movement axis 41 of a piston member 4, wherein the open segment 51 contacts with a pressing face 221. The cushion washer 5 also includes a raised close segment 52 formed on a second end thereof and correspondingly abuts against to the closing face 121 of the chamber 120 of the fitting sleeve 12, wherein the raised close segment 52 has a central position higher than its two sides. With reference to FIG. 8, in anther embodiment, the cushion washer 5 includes two open segments 51 arranged on a first end and a second end thereof, and each open segment 51 has at least one air groove 511 with a mouth parallel to a movement axis 41 of a piston member 4.

Thereby, the cushion device of the present invention has advantages as follows:

1. The cushion washer 5 is mounted in the chamber 120 of the fitting sleeve 12 of the body 1, and the cushion washer 5 abuts against the closing face 121 of the chamber 120 of the fitting sleeve 12 and the pressing face 221 of the abutting portion 22 of the cylinder 2, wherein the cushion washer 5 includes at least one open segment 51 arranged on at least one end thereof, the open segment 51 has the at least one air groove 511, and the at least one open segment 51 contacts with the closing face 121, such that when the piston member 4 moves backward to impact the valve unit 3, the cushion washer 5 and the at least one air groove 511 produce the compression like the airbag to absorb the vibration doubly and to reduce the reaction force of the cylinder 2 which passes toward the user's hand, thus protecting the user's wrist.

2. The cushion washer 5 includes the at least one open segment 51 arranged on the at least one end thereof, and the open segment 51 has the at least one air groove 511, hence the cushion washer 5 does not cause elastic fatigue in repeated use, thus reducing use cost.

While various embodiments in accordance with the present invention have been shown and described, it is clear to those skilled in the art that further embodiments may be made without departing from the scope of the present invention.

What is claimed is:

1. A cushion device for a cylinder of a pneumatic tool, and the pneumatic tool comprising:

a body including a grip and a fitting sleeve fitted with the grip, the fitting sleeve having a chamber defined therein, a closing face formed on a first end thereof, and an opening formed on a second end thereof;

a cylinder slidably fitted in the chamber of the fitting sleeve, and a part of the cylinder extending out of the fitting sleeve from the opening of the chamber, the cylinder including a room formed therein and an abutting portion adjacent to the closing face of the chamber of the fitting sleeve;

a valve unit mounted between the room and the abutting portion of the cylinder;

a piston member accommodated in the room of the cylinder and sliding forward and backward along a movement axis;

a cushion washer made of a flexible rubber and mounted in the chamber of the fitting sleeve, and the cushion washer abutting against the closing face of the chamber of the fitting sleeve and the pressing face of the abutting portion of the cylinder, wherein the cushion washer includes at least one open segment arranged on at least one end thereof, the at least one open segment has the at least one air groove, and each of the at least one air groove having a mouth parallel to the movement axis of the piston member, the at least one open segment contacts with the closing face and/or the pressing, such that the at least one air groove forms a flexible press space, thus producing double flexibility by using the cushion washer which is made of the flexible rubber and the at least one air groove which forms the flexible press space.

2. The cushion device for the cylinder of the pneumatic tool as claimed in claim 1, wherein the cylinder includes a limiting slot defined on an outer side thereof to insert a defining element of the fitting sleeve.

3. The cushion device for the cylinder of the pneumatic tool as claimed in claim 1, wherein the cushion washer includes an open segment arranged on a first end thereof and abutting against the closing face of the chamber of the fitting sleeve, and the cushion washer also includes a close segment formed on a second end thereof and abutting against the pressing face of the abutting portion of the cylinder.

4. The cushion device for the cylinder of the pneumatic tool as claimed in claim 3, wherein the close segment is raised and has a central position higher than its two sides.

5. The cushion device for the cylinder of the pneumatic tool as claimed in claim 1, wherein the cushion washer includes an open segment arranged on a first end thereof and abutting against the pressing- face of the abutting portion of the cylinder, and the cushion washer also includes a close segment formed on a second end thereof and abutting against to the closing face of the chamber of the fitting sleeve.

6. The cushion device for the cylinder of the pneumatic tool as claimed in claim 5, wherein the close segment is raised and has a central position higher than its two sides.

7. The cushion device for the cylinder of the pneumatic tool as claimed in claim 1, wherein the cushion washer includes two open segments arranged on a first end and a second end thereof.

8. The cushion device for the cylinder of the pneumatic tool as claimed in claim 1, wherein the pressing face of the abutting portion of the cylinder has a protective pad fixed on a central position thereof to contact with the close segment of the cushion washer.

* * * * *